US008719982B2

(12) United States Patent
Kelly

(10) Patent No.: US 8,719,982 B2
(45) Date of Patent: May 13, 2014

(54) INFANT FEEDING PILLOW

(76) Inventor: Jane Kelly, Denver, CO (US)

( * ) Notice: Subject to any disclaimer, the term of this patent is extended or adjusted under 35 U.S.C. 154(b) by 0 days.

(21) Appl. No.: 13/204,697

(22) Filed: Aug. 7, 2011

(65) Prior Publication Data

US 2013/0031724 A1 Feb. 7, 2013

(51) Int. Cl.
*B68G 5/00* (2006.01)
*A47D 13/00* (2006.01)

(52) U.S. Cl.
USPC ..... 5/655

(58) Field of Classification Search
USPC ..... 5/655, 632, 646, 633, 652
See application file for complete search history.

(56) References Cited

U.S. PATENT DOCUMENTS

| | | | | |
|---|---|---|---|---|
| 5,029,351 | A * | 7/1991 | Weber | 5/655 |
| 5,154,649 | A * | 10/1992 | Pender | 5/655 |
| 5,551,109 | A * | 9/1996 | Tingley et al. | 5/655 |
| 5,790,999 | A * | 8/1998 | Clark | 5/655 |
| 6,484,337 | B1 * | 11/2002 | Moe et al. | 5/652 |
| 6,564,408 | B2 * | 5/2003 | Van Vuuren | 5/655 |
| 6,658,681 | B2 * | 12/2003 | Britto et al. | 5/655 |
| 7,111,347 | B1 * | 9/2006 | Cottrell | 5/655 |
| D571,596 | S * | 6/2008 | Alvistur et al. | D6/601 |
| 7,454,808 | B2 * | 11/2008 | Parrilla | 5/655 |
| 7,886,383 | B1 * | 2/2011 | Plimmer | 5/655 |
| 8,590,078 | B1 * | 11/2013 | Zenoff | 5/655 |
| 2002/0023301 | A1 * | 2/2002 | Vuuren | 5/655 |
| 2004/0060116 | A1 * | 4/2004 | Matthews Brown | 5/636 |
| 2005/0235425 | A1 * | 10/2005 | Parrilla | 5/655 |
| 2006/0162080 | A1 * | 7/2006 | Littlehorn et al. | 5/652 |
| 2006/0179575 | A1 * | 8/2006 | Goodwin et al. | 5/655 |
| 2006/0265809 | A1 * | 11/2006 | Wagner | 5/655 |
| 2009/0133192 | A1 * | 5/2009 | Hassell et al. | 5/639 |
| 2009/0199343 | A1 * | 8/2009 | Collins | 5/655 |
| 2009/0235459 | A1 * | 9/2009 | Tidwell et al. | 5/640 |

* cited by examiner

*Primary Examiner* — William Kelleher
*Assistant Examiner* — Myles Throop
(74) *Attorney, Agent, or Firm* — James A. Sheridan; Sheridan Law, LLC

(57) ABSTRACT

This invention is a pillow placed on the lap for supporting a baby while feeding. The pillow raises the baby on an inclined plane, with ridges on the lower and upper outer edges for added safety and stability, and has a curved, yet light and compact body to fit comfortably in front of the caregiver's torso. If breast feeding, the mother lifts the baby and turns the pillow over vertically to feed on the other breast. For the lengthy and repetitive task of feeding an infant, the pillow securely supports and elevates the baby; this benefits both the baby, by reducing acid reflux, and the caregiver, by decreasing stress on the arms and back as well as presenting the option to be hands-free.

20 Claims, 4 Drawing Sheets

INFANT FEEDING PILLOW

FIELD OF INVENTION

This invention relates to pillows for supporting infants while nursing or bottle feeding.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Breastfeeding, recommended for optimal infant nutrition, is a wonderful bonding opportunity for a mother and baby. However, it can be a tiresome, uncomfortable and sometimes painful repetitive task without the adequate support. A mother's fatigue and bad posture due to hunching over or lifting the baby in awkward positions over time often lead to chronic pain and distress. Additionally, improper positioning is the reason for most latching-on problems, deterring many mothers from continuing to breastfeed.

Prior pillows intended for nursing infants fail to provide sufficient, comfortable support to properly position the baby in a way to promote good digestion. Most designs provide no incline or a planar surface, such as the well-known Boppy (U.S. Pat. No. 5,261,134, Matthews, 1993). The Boppy, not originally intended for breastfeeding, is rounded, large, and fits around the mother's torso. It lacks the necessary incline to raise the baby comfortably to the mother's breast and does not mimic the natural cradle-hold of a mother's arms. The rounded edges of the Boppy cause the baby to roll toward or away from the mother. The padding is also heavy and bulky making it cumbersome and not easily moved.

Although wedge shape design patents exist, most are not ideal for a number of reasons. The patent provided to Cottrell is a wedge with an exaggerated incline, with an angle of 22-30 degrees, causing the baby to slide down the pillow and consists of straight edges along the elongated body that do not conform suitably to the caregiver's body (U.S. Pat. No. 7,111,347, Cottrell, 2006). In U.S. Pat. No. 5,581,833, issued to Zenoff in 1994, the support pillow has a removable wedge that spans only a portion of the pillow and includes lumbar support that pushes the wearer's back forward, impeding proper posture. An inflatable wedge design for this application is large (20 inches to 30 inches in length) thus does not fit well into narrow seating arrangements. It furthermore lacks the interior curvature depth necessary for comfort with only a 2-inch contour (U.S. Pat. No. 5,133,098, Weber, 1992). In U.S. Pat. No. 6,564,408, issued to Van Vuuren in 2003, the pillow's wedge shape is flanked by two armrests. It may not be moved laterally to adjust the height and furthermore is larger and more cumbersome than the present invention. In U.S. Pat. No. 7,832,036, issued to Littlehorn, et al. in 2010, the pillow is two pieces, with a removable wedge that attaches to the top of the pillow in the midsection and is flipped for use on the other side; however, this wedge is separate and only spans half of the pillow, thus providing a short elevated surface. Additionally, the edges are rounded so they do not provide sufficient support up to the edge of the pillow where it is needed.

Most notably, all prior nursing pillows fail to provide an outer-ridge support. The lower portion of an outer-ridge supplies the appropriate lift underneath. This means the pillow surface stays level and close to the caregiver and the pillow is more stable, reducing the risk of the pillow and baby falling off of the lap. The need for additional pillow supports or arm strain is eliminated. The upper portion of an outer-ridge serves as a safety border to keep the baby securely on the pillow.

This invention addresses all of these issues, providing support to both mother and baby to promote healthy and natural positioning for comfort, best latch and less reflux.

BRIEF SUMMARY OF THE INVENTION

The flat plane, gentle incline and curved shape of the invention enable successful breastfeeding and general feeding best practices. The contour of the pillow to the torso keeps the pillow and baby comfortably close to the caregiver and provides support out to the edges where it is needed. The firm, flat plane keeps the baby's spine in a straight line. The incline raises the baby's head to breast level, reducing acid reflux for the baby and stress on the caregiver's arms and back. The pillow may be moved laterally across the caregiver's torso to adjust the incline.

This invention's foam embodiment is light, compact, and easily transported, fitting well in common narrow seating arrangements like rockers, airplane seats or car seats. If breast feeding, the pillow is designed to rotate vertically to position the baby correctly on the other breast. The baby is lifted off of the pillow and supported on mothers shoulder, e.g. while burping the baby, before being positioned on the opposite side. The pillow also provides adequate support in seats, sofas or benches that do not have arms. The well-supported height and curvature of this invention will further help mothers who have experienced C-sections and cannot easily bend their torso.

A salient feature of this invention is an integrated support ridge adjacent to the outer edge of the pillow. The bottom part of the ridge correctly angles the pillow on the caregiver's lap for maximum comfort and stability for the baby and the caregiver. The upper part of the ridge serves as a safety border to keep the baby secure and close to the caregiver. The combined support and safety features allow the mother to be hands free so that she may use a keyboard, read a book, etc. while feeding.

An outer cover may be provided to remove and wash at the user's convenience. Additionally, this cover may be partially or fully waterproof and include a removable safety belt that attaches to the pillow and wraps around the caregiver's lower back and/or neck to provide additional safety. This strap not only secures the pillow to the mother but also aids as a strap for transport.

DETAILED DESCRIPTION OF THE INVENTION

Figure 1:
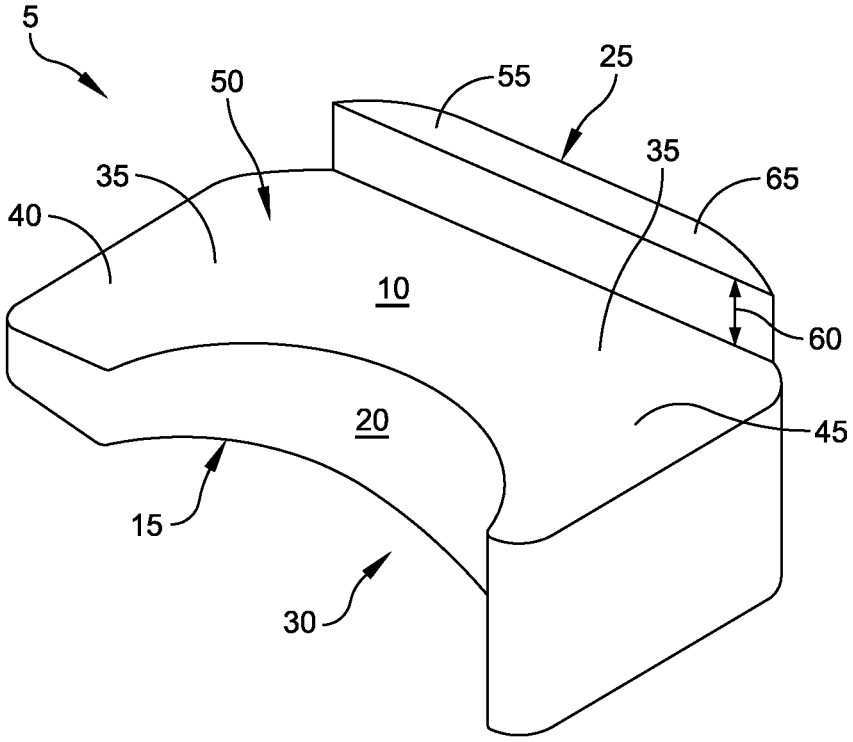
FIG. 1 is a perspective view of my invention showing the contoured, wedge shaping of the pillow and outer support/safety ridge.

FIG. 1 shows a baby support pillow 5 in accordance with this invention, with its particular shaping characteristics. The pillow 5 provides soft yet firm, generally planar top and bottom surfaces 10, 15 that provide required support for the baby's spine and head, shaped to fit along the caregiver's torso.

A contoured inside 20 is shaped to rest along the caregiver's belly and the crescent outer edge 25 is shaped to fit comfortably in the caregiver's arms. The contoured cut out 30 is preferably large enough to allow for some side-to-side movement of the pillow 5. This embodiment portrays a 12-inch wide by 4-inch curved cut out.

The wedge feature 35 is important in that it elevates the baby's head while eating. This promotes natural digestion, and can help to reduce the incidence of ear infections and acid reflux caused by feeding a baby while in the horizontal position. The baby's head elevated to breast level also lessens the strain on a mother's arms.

Figure 2:
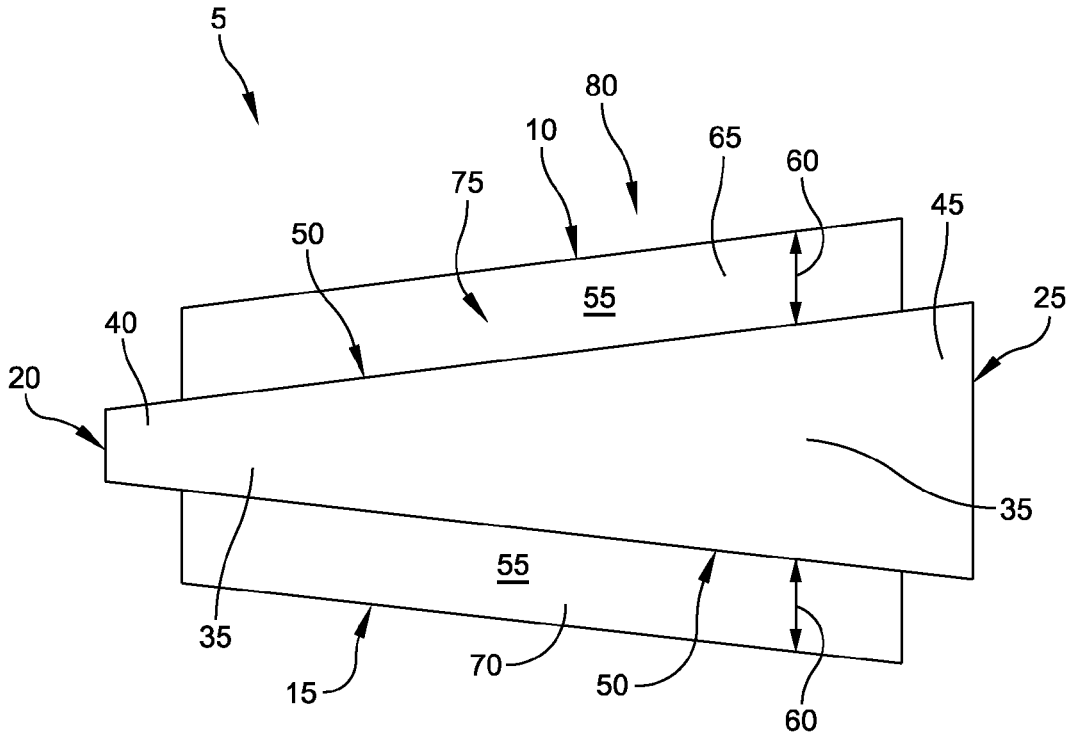
FIG. 2 is a side view of the invention.

FIG. 2 shows a side view of the invention, wherein the thin end 40 of this drawing is 1.5 inches thick and the thick end 45 is 6 inches thick. The slope 50 is intended to be moderate with a range of 10 to 30 degrees. The support bolster pillow 55 attached to the main pillow 5 in this embodiment allows for a 2-inch ridge 60 along the top 65 and bottom 70. In this embodiment, a foam "ridge" pillow 55 is sewn, attached with Velcro, or otherwise attached to the main pillow. The purpose of the support bolster 55 is to provide lift to keep the surface 10 or 15 level and provide more stability so that the pillow 5 doesn't fall away from the caregiver. The upper part 75 of outer rim 80 serves as a safety border to keep baby on the pillow 5.

Figure 3:
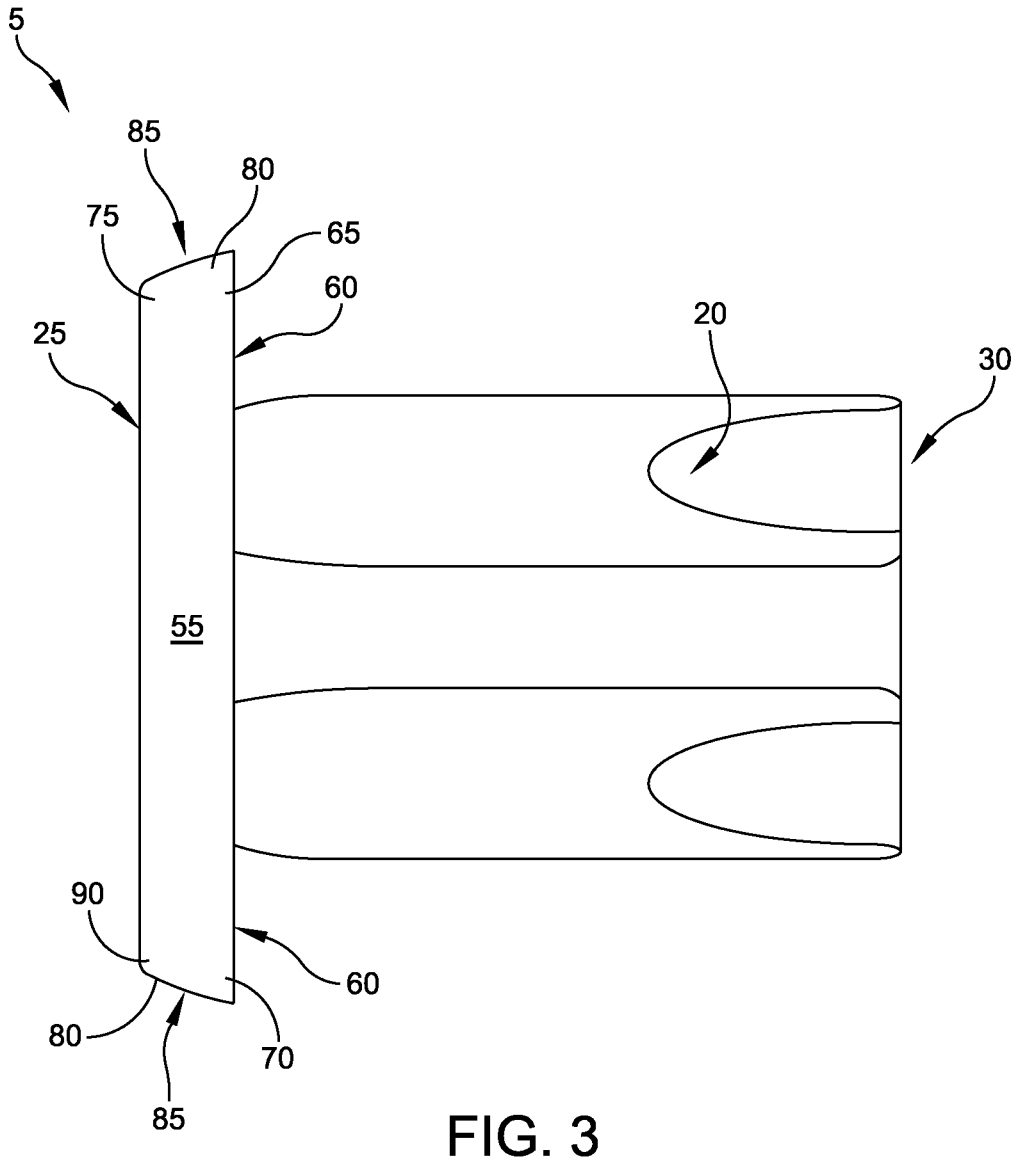
FIG. 3 is a perspective side view of the lower portion of the wedge.

FIG. 3 shows a perspective side view of the lower portion of the wedge 35 and the corresponding shape, angled up to provide a well-supported, gentle elevation for the baby. Also shown is a planar surface 85 that is angled toward the mother by the lower part 90 of the outer rim 80 to provide stability and bordered by the upper part 75 of the rim 80 for safety.

Figure 4:
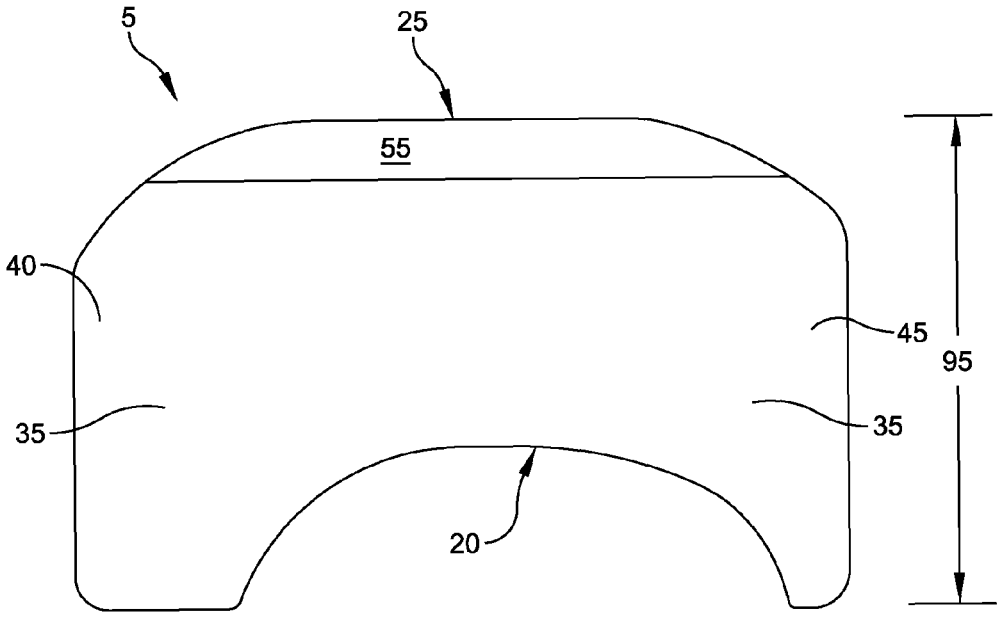
FIG. 4 is a top view of the invention.

FIG. 4 shows a top view of the invention. The length shown in this embodiment is 19 inches. The compact nature of the design allows for the pillow 5 to fit in narrow seating arrangements such as glider rockers and airplane seats. The width 95 (surface area perpendicular to the user) is approximately 7 inches.

By simply lifting the baby and rotating the baby support pillow vertically, the baby can be easily repositioned to nurse on the other breast. The baby support pillow can also be set beside the mother to allow for breastfeeding the baby in what is commonly called the "football hold" position. Used regularly for breast feeding, the pillow can greatly reduce the stress and fatigue on the mother's body.

The baby support pillow can also be used to more comfortably and safely hold the baby reclining on its back, on a seated person's lap. This positioning of the baby support pillow can be useful for bottle feeding, dressing and social interactions. Extra padding may be integrated for the correct alignment of the baby's neck, shoulders and head.

It should be understood that the dimensions suggested above can be varied to provide for a small, medium, and large size of this invention. Furthermore the materials suggested could be varied and the invention or its parts could be made inflatable. The outer, removable slipcover could include handles, pockets, a belt and a privacy panel for convenience.

While my above description contains many specifications these should not be construed as limitations on the scope of the invention, but rather as an exemplification of one preferred embodiment thereof. Many other variations are possible. As a result, the scope of the invention should be determined not by the embodiments illustrated, but by the appended claims and their legal equivalents.

The invention claimed is:

1. A baby support device, comprising:

an elongated body having a thin end and a thick end in opposition to one another, a longitudinal axis extending between the thin end and the thick end, and a lateral axis extending perpendicular to the longitudinal axis;

a first surface and a second surface in opposition to one another, the first surface and the second surface providing opposed surfaces disposed between the thin end and the thick end, the opposed surfaces forming a wedge between the thin end and the thick end, and the opposed surfaces configured to support a baby on either one of the opposed surfaces when a selected one of the opposed surfaces is disposed in a position upwardly away from a lap of a seated person;

a curved, contoured cut out positioned between the thin end and the thick end, the curved, contoured cut out configured to position the elongated body against a body of the seated person;

a ridge positioned between the thin end and the thick end, the ridge disposed, in a direction of the lateral axis, in opposition to the curved, contoured cut out, the ridge extending a first distance above the selected one of the opposed surfaces and a second distance below the other one of the opposed surfaces from the opposed surfaces when the selected one of the opposed surfaces is disposed in a position upwardly away from a lap of a seated person, the ridge providing:

an upper safety border extending the first distance above the selected one of the opposed surfaces when the one of the opposed surfaces is disposed in a position upwardly away from the lap of the seated person; and a lower support bolster extending the second distance below the other one of the opposed surfaces when the other one of the opposed surfaces is disposed in a position downwardly toward the lap of the seated person, and the second distance below the other one of the opposed surfaces configured to level the elongated body when disposed on the lap of the seated person and provide stability to prevent migration of the elongated body.

2. The baby support device of claim 1, wherein the ridge is positioned outwardly of the opposed surfaces.

3. The baby support device of claim 1, wherein the ridge is configured to provide stability and improved positioning on the lap of the seated person with the lower support bolster.

4. The baby support device of claim 1, wherein the ridge is configured to keep the baby on the selected one of the opposed surfaces with the upper safety border.

5. The baby support device of claim 1, wherein the one of the selected opposed surfaces has a sufficient size configured to support the baby when put between the baby and the legs of the seated person's legs.

6. The baby support device of claim 1, wherein a length of the opposed surfaces in a direction of the longitudinal axis is greater than a lateral width.

7. The baby support device of claim 6, wherein the lateral width is configured to support the baby.

8. The baby support device of claim 1, wherein the opposed surfaces are similarly shaped to one another, and non-parallel to one another, so as to form a wedge shaped with a moderate slope in a direction of the longitudinal axis.

9. The baby support device of claim 1, wherein the thick end is configured with a height for alignment of a mouth of the baby for nursing with a breast of the seated person.

10. The baby support device of claim 1, wherein the thick end is configured with a height for maintaining a mouth of the baby above feet of the baby to position the baby for one of bottle and breast feeding on the lap of the seated person.

11. The baby support device of claim 1, wherein the opposed surfaces are configured to be rotated vertically 180 degrees to orient a slope between the thin end and the thick end in either direction so as to nurse the baby in two longitudinal directions without reconfiguration beyond 180 degrees of vertical rotation of the opposed surfaces.

12. The baby support device of claim 1, wherein the elongated body comprises foam.

13. The baby support device of claim 1, wherein the elongated body comprises stuffing material.

14. The baby support device of claim 1, wherein the elongated body comprises plastic.

15. The baby support device of claim 1, wherein the elongated body is inflatable with one or more compartments.

16. The baby support device of claim 15, wherein the at least one removable, washable outer cover includes handles.

17. The baby support device of claim 15, wherein the at least one removable, washable outer cover includes pockets.

18. The baby support device of claim 15, wherein the at least one removable, washable outer cover includes a safety belt.

19. The baby support device of claim 15, wherein the at least one removable, washable outer cover includes a privacy panel.

20. The baby support device of claim 1, wherein the elongated body includes at least one removable, washable outer cover.

* * * * *